US005894940A

United States Patent [19]

Gusdorf et al.

[11] Patent Number: 5,894,940

[45] Date of Patent: Apr. 20, 1999

[54] VERTICAL WALL RACK AND VARIABLE SHOE HOLDER ARRANGEMENT

[75] Inventors: John Gusdorf; Fred D. Oberhaus, both of St. Louis County, Mo.

[73] Assignee: Industrial Wire Products, Inc., Sullivan, Mo.

[21] Appl. No.: 08/854,392

[22] Filed: May 12, 1997

Related U.S. Application Data

[63] Continuation-in-part of application No. 08/505,465, Jul. 21, 1995.

[51] Int. Cl.[6] ..... A47F 5/00

[52] U.S. Cl. ..... 211/35; 211/103; 211/106; 211/119.004; 211/94.02

[58] Field of Search ..... 211/103, 106, 211/119.004, 113, 117, 35, 94.02, 90.04, 90.03; 248/220.31, 220.43

[56] References Cited

U.S. PATENT DOCUMENTS

| | | | |
|---|---|---|---|
| 1,200,361 | 10/1916 | Johnson et al. . | |
| 2,195,919 | 4/1940 | Crilly et al. . | |
| 2,827,254 | 3/1958 | Faber . | |
| 3,002,629 | 10/1961 | Gersin et al. . | |
| 3,198,343 | 8/1965 | Pollock | 211/87.01 |
| 3,290,846 | 12/1966 | Mader et al. | 211/90.04 X |
| 3,652,048 | 3/1972 | Hartman | 211/90.04 X |
| 3,913,745 | 10/1975 | Weiss . | |
| 3,918,670 | 11/1975 | Doherty | 211/35 X |
| 4,461,387 | 7/1984 | Belokin, Jr. . | |
| 5,076,942 | 12/1991 | Hakeem | 211/35 X |
| 5,472,103 | 12/1995 | Merl | 211/90.04 X |
| 5,477,967 | 12/1995 | Voorhees et al. | 211/103 X |
| 5,526,941 | 6/1996 | Ford | 211/106 X |
| 5,645,177 | 7/1997 | Lin | 211/103 X |
| 5,695,073 | 12/1997 | Klein et al. | 211/35 |

*Primary Examiner*—Robert W. Gibson, Jr.
*Attorney, Agent, or Firm*—Paul M. Denk

[57] ABSTRACT

A storage system having a pair of parallel, spaced side runners and a plurality of interchangeable wire racks secured and suspended between the side runners. The runners are mounted directly to a wall or other flat surface. The runners are provided in interlocking sections and can be joined together to form a runner as long as desired. Each runner has a plurality of evenly spaced openings formed along the length of a center section. The openings in one runner are parallel to the openings in the other runner. Each runner includes a pair of retention ridges on the front surface of the center section extending the length of the that section on each side of the openings. There are plurality of retention tabs on the back surface of flat section with a tab on each side of the opening. Each rack has mounting extensions designed to engage the openings in the runners. Each mounting extension has an vertical section that snaps between the ridges on the front side of the runner and a tip that engages and is secured in the opening and snaps between the retention tabs on the back side of the runner. One embodiment of the rack has a plurality of upward angled loops for holding a shoe.

14 Claims, 5 Drawing Sheets

VERTICAL WALL RACK AND VARIABLE SHOE HOLDER ARRANGEMENT

This application is a continuation-in-part of application Ser. No. 08/505,465, filed Jul. 21, 1995, owned by the same assignee.

BACKGROUND OF THE INVENTION

This invention relates to storage systems, more particularly to an adjustable wire rack storage system for holding shoes.

Shelving units are known to the art. In general, shelves must be built into a building upon construction or renovation to afford storage space to the inhabitant. In most cases, storage areas are planned into the building in the form of closets, cabinets or pantries. These planned storage areas generally contain some shelving to facilitate the orderly storage of belongings. Once the construction or renovation of the building is completed the storage space is limited to those preplanned storage areas. It is time consuming and expensive to add additional storage. It is not uncommon to discover, upon completion of construction or renovation, that the storage areas are limited. That is, the inhabitants of the building often discover that they need more storage space or that the storage space provided is unhandy. Furthermore, as the number of inhabitants increases, more storage space is needed.

Often a homeowner realizes that the closets or cabinets are too small to accommodate all of the items to be stored. For example, the closets may be too small to accommodate shoes as well as clothing and other items. Moreover, even in situations where there is sufficient storage space, it may be desirable to better organize the items stored. For example, shoes of various styles and for various uses may scattered about a room or closet. Further, shoes are often kept in the shoebox and stacked on the floor of the closet. This type of storage is inconvenient in that the boxes have to be sorted through or moved to get to boxes on the bottom of the stack. Moreover, the shoe boxes deteriorate or break down from use.

Various shoe racks are known to the art. Generally these rack consist of tiers of racks or shelves that rest on the floor and the shoes are aligned on the tiers of racks or shelves. Other shoe racks are holders are designed to suspend from the closet clothes rod, for example the rack disclosed in U.S. Pat. No. 3,913,745 to Weiss, but they impinge on the clothes hanging area. U.S. Pat. No. 3,002,629 illustrates a display clip that can hold a shoe, but appears to be use with peg board and is designed to hold a shoe for display in a store and is not particularly adaptable to home use. U.S. Pat. No. 5,076,442 to Hakeem, discloses a shoe organizational system with slide out racks that is complex in construction and designed to mount in a closet.

It would be desirable to have a simple storage system having shoe storage components that is easily installed to increase the amount of shoe storage area. An ideal storage system could be mounted in unused space, for example, on the back of a closet door, so as to not impinge on usable closet space. The shoe rack should have adjustable rack units that can be positioned as desired. However, the adjustable racks must be secured to a frame so as to securely remain in place under the weight of the shoes.

OBJECTS OF THE INVENTION

It is, therefore, among the principal objects of the present invention to provide a storage system that can be assembled and mounted in an existing closet or other space to facilitate the organization and storage of shoes and other items.

A further object of this invention is to provide substantial stability to the mounting and support of items against a vertical surface, whether it be a wall, door, or the like through the use of an integrated vertical wall side runners and various moveable rack or shelf arrangements.

A further object of this invention is to provide a storage system that, when disassembled, as for shipment and display, can be reduced to substantially small dimensions, with no section being over four feet in length, while prior art devices come in much greater sizes, add to the inconvenience of their usage.

Still another object of this invention is to provide a vertical storage system which is completely adjustable, providing for various types of shelving, at various levels, depending on the desire of the user.

It is another object of the present invention to provide such a storage system that includes runners with interchangeable rack components so as to maximize the utility of the system.

Another object of the invention is to provide such a storage system wherein the interchangeable racks or shelves lock into the runners so that the racks or shelves are secured to the runners under the weight of the shoes or other stored items on the racks.

Still another object of the present invention is to provide such a storage system that can be installed in existing structure and requires no structural modification.

Yet another object of the present invention is to provide such a storage system that can maximize preexisting storage space.

Another object of the invention is to provide such a storage system that is economical to manufacture, easy to install, easy to use, and well suited for its intended purposes.

In accordance with the invention, briefly stated, a storage system having a pair of spaced side runner and a plurality of interchangeable wire racks suspended between the runners. The runners are mounted directly to a wall or other surface, or even to the inside surface of a door. The vertical runners are provided in interlocking sections and can be joined together to make a side runner as long as desired. Each side runner section has a plurality of openings in a center body section. The openings in one side runner are parallel to the openings in the other side runner. Each runner has a pair of elongated raised ribs that extend the length of the runner, one each of each ridges being position on each side of the openings. The ribs include retention beads that impinge on the opening. The back side of the runner includes a plurality of locking tabs, one each of the tabs being position in each side of an openings with each tab having a retention bead that impinges on the backside of the opening. Each rack has a substantially S-shaped attachment extension on each end designed to engage the openings. Each side extension terminates in an engagement tip that engages the opening and locks between the locking tabs on the back side of the runner. The attachment extension also includes a vertical section that snaps between the retention beads on the front side of the runner. The engagement extensions are thus secured in the openings to suspend the rack between the side runners. The rack can be released from the openings moved between parallel openings so as to raise or lower the height of the rack.

Figure 1:
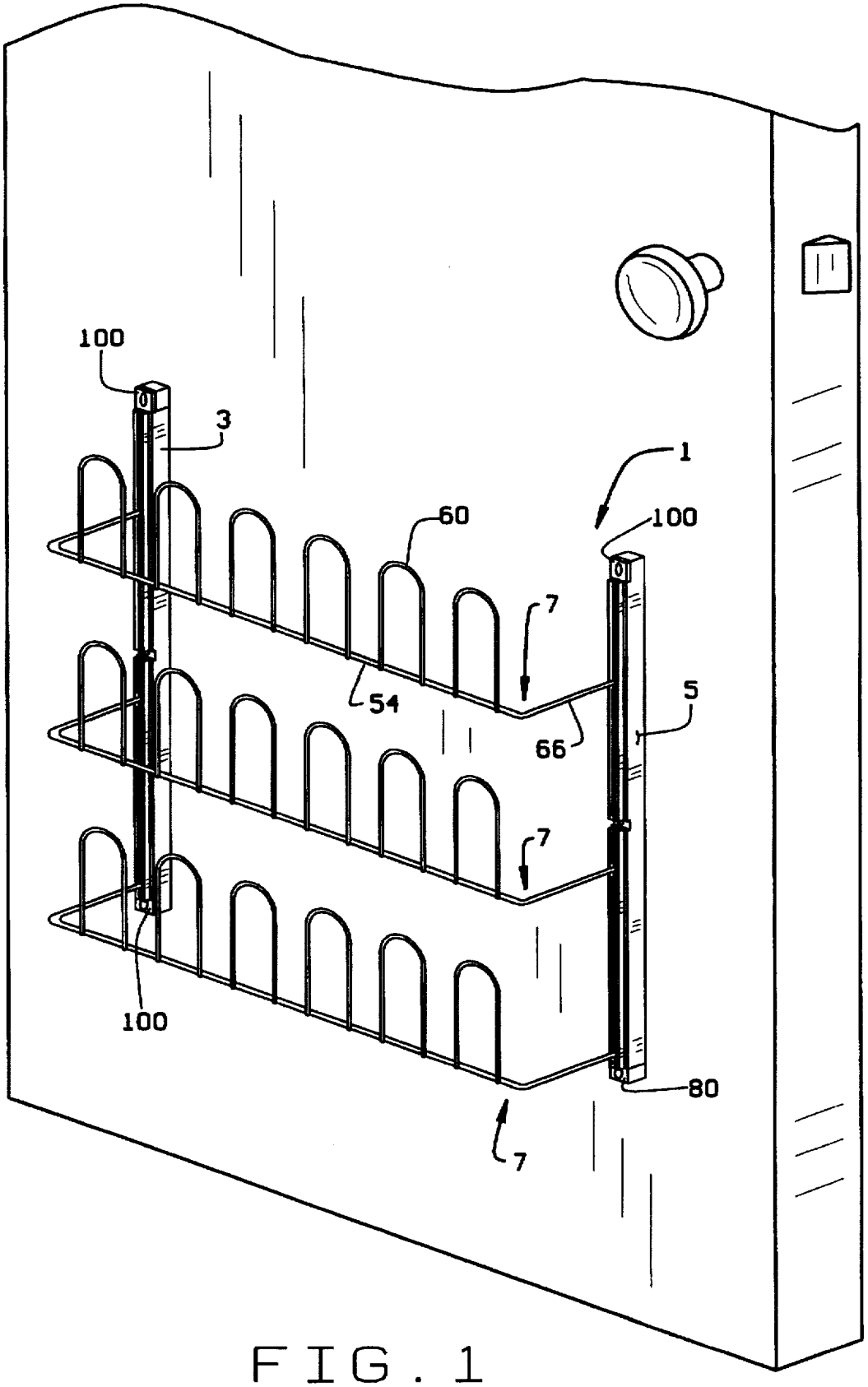
FIG. 1 is an isometric view of a single section of the adjustable wire rack system of the present invention attached to the backside of a door.

Corresponding reference figures indicate corresponding structure throughout the various drawings.

DESCRIPTION OF THE PREFERRED EMBODIMENT

An adjustable wire storage system of the present invention is indicated generally by reference numeral 1 in the drawings. Storage system 1 has a pair of opposed side runners 3 and 5 as well as a plurality of interchangeable racks 7. The individual elements of system 1 will now be described in greater detail.

Figure 2:
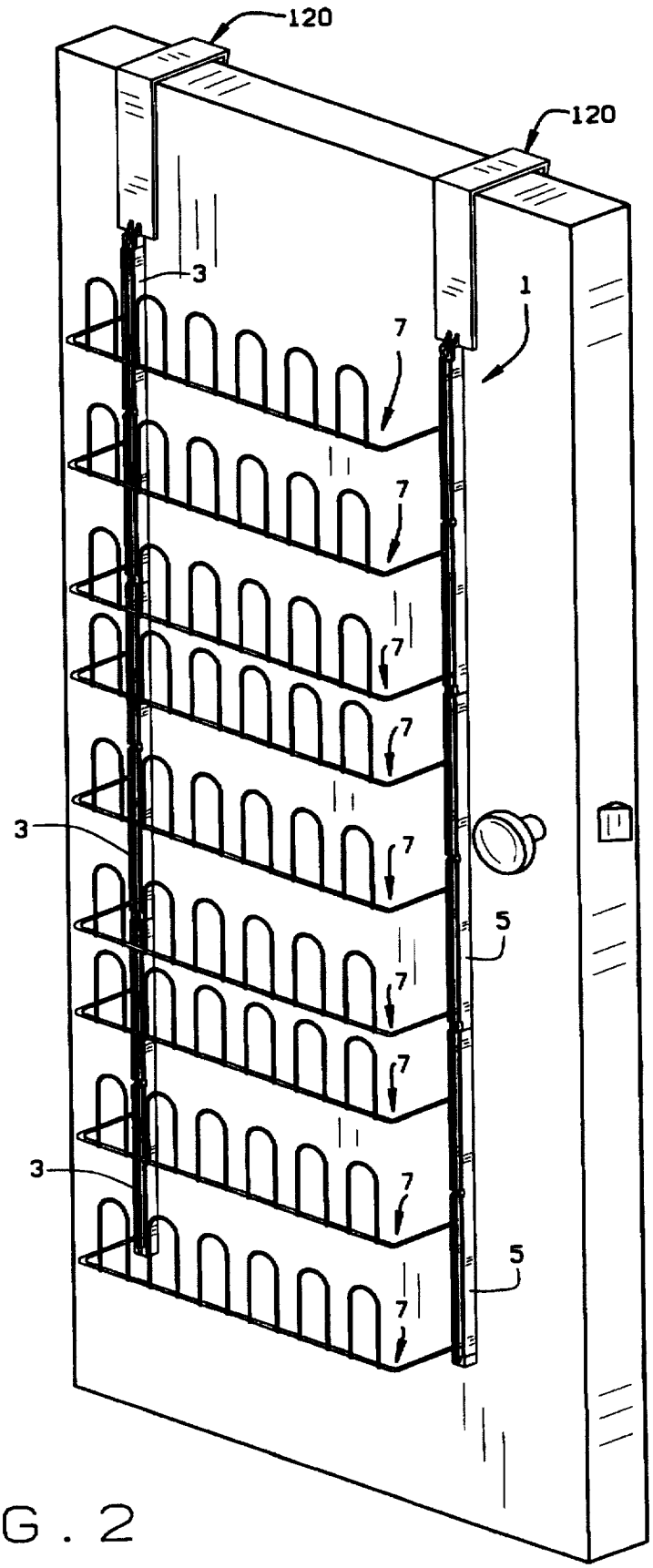
FIG. 2 is an isometric view of an expanse of the adjustable wire rack system of the present invention attached to the backside of a door.

As can be seen in FIG. 1, the storage system 1 provides plurality of racks 7 mounted to the vertical runners of this invention and connected to a relatively flat mounting surface, such as door D. FIG. 2 shows the system containing a pair of vertically aligned side runners comprised of a plurality of spaced apart runner sections 3 and 5 connected end to end, with a series of racks 7 and discloses how a series of racks can be applied at various height dimensions to furnish a multiple storage of pairs of shoes at any given time. The sections or runner 3,5, as will be described in greater detail below, can be interconnected to make a system of any desired height, from a single section, as shown in FIG. 1 to multiple sections, as shown in FIG. 2.

In addition, the racks 7 may be of differing sizes or configurations. For the purposes of simplicity of illustration, the racks 7 are shown designed for holding a plurality of shoes. However, the racks may have any useful configuration, including shelves, bins, racks and so forth. For example, the system can accommodate any type of rack or shelf as disclosed in the co-pending application Ser. No. 08/505,465, filed Jul. 21, 1995 and owned by a common assignee as the instant case. It will be appreciated, therefore, that when the term rack is used hereinafter it is intended to include anytime of support structure that can be suspended between the runners.

Further, where the rack may be used for supporting different styles of shoes, the shoe racks may be of a narrower or wider width and, therefore, the use of one or more runners, incorporating a series of vertically located shoe racks, may be used alone in this installation.

It is to be noted that what is significantly convenient through the usage of this invention is the application of the novel retention means for holding the racks 7 to the runners 3, 5, and into which various of the racks may conveniently, and with high stability, fit for holding the assembled vertical storage system together, into position, for application to a vertical surface, such as a wall.

Figure 5:
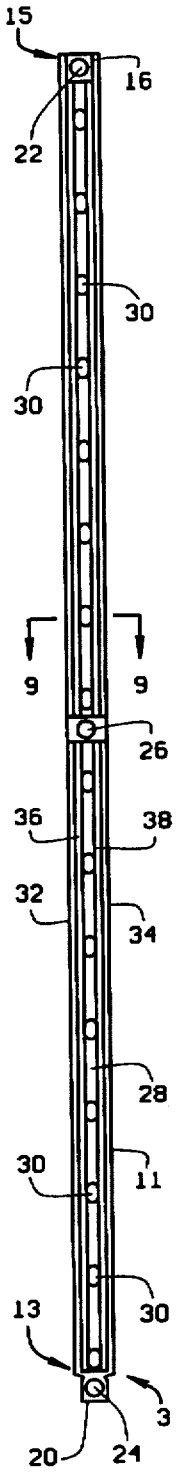
FIG. 5 is a front elevation of a section of runner of the adjustable wire rack system of the present invention.
Figure 6:
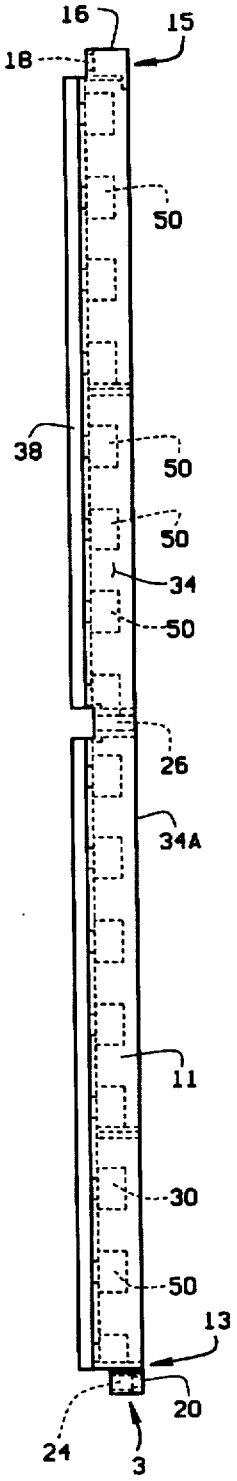
FIG. 6 is a side elevation thereof.
Figure 7:
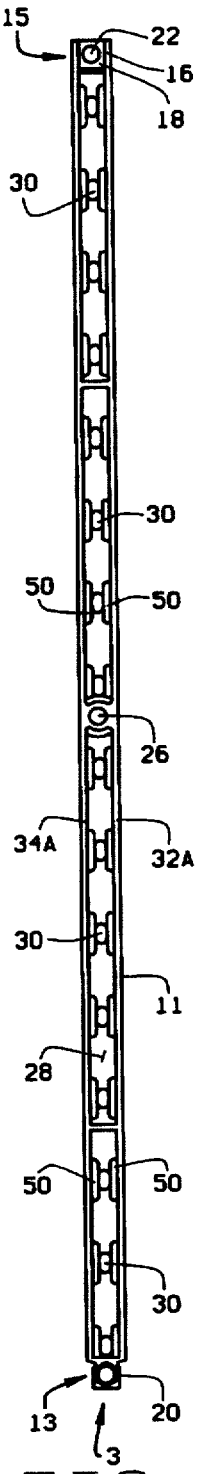
FIG. 7 is a rear elevation thereof.
Figure 8:
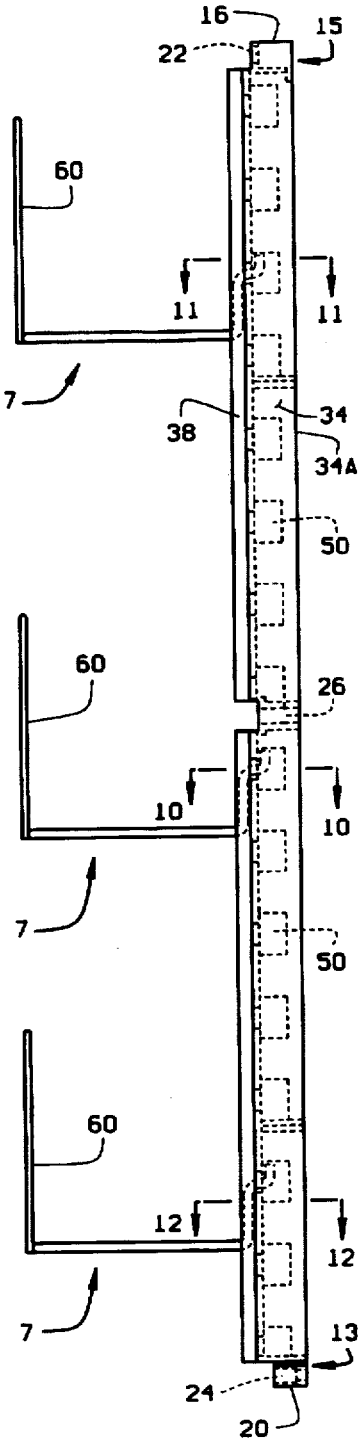
FIG. 8 is a side elevation of a section of the adjustable wire rack system of the present invention.

Side runner 3 is shown in greater detail in FIGS. 5–12. Runner 5 is exactly the same as runner 3 in design. It will be appreciated that the runners 3, 5 come in interlocking sections of variable length so that any number of sections can be interconnected to make a runner of desired length, as mentioned above and as will be described in greater detail hereinafter. Each section of runner is made from an appropriate material such as a lightweight painted or vinyl coated metal or plastic of sufficient strength and durability. Each section of runner 3 has a elongated body 11 having bottom first end 13 and a top or second end 15. As best seen in FIGS. 6 and 8, the top end 15 has a connector section 16. Connector section 16 includes is open on the back side and includes a cavity 18. Correspondingly, the bottom end 13 includes a connector section 20 which is essentially a cube having external dimensions complementary to cavity 18. Section 20 is slightly undersized relative to cavity 18 and can slide into the cavity 18 from the back side and snap in with a snug friction fit when a plurality of runners 3 are in vertical, linear alignment so as to interlock the runners 3 to form a longer runner. As shown, connector section 16 has a hole or opening 22 and section 20 has a hole or opening 24. When section 20 is inside section 16 openings 22 and 24 are in axial alignment and allow the insertion of screws 25 (FIG. 1) or nails or other appropriate mounting means to attach the runners to a surface. Also as shown, the runner includes a third opening 26 at a midpoint between the two ends to accommodate a mounting means.

As best seen in FIGS. 5 and 6, body 11 includes a center section 28. There is a plurality of evenly spaced openings 30 formed through section 28 that are open to the front and back of the runner. The openings 30 have a slightly ovoid shape, i.e. being slightly longer than wide. Body 11 has a pair of outer walls 32, 34 that extend along the edges of section 28 and which extend the length of the body. Walls 32, 34 protrude beyond the back side of flat section 28, as shown as 32A and 34A so as to elevate the runner from the mounting surface, as will be explained below. Body 11 also includes a pair or ribs 36,38 on the front side of section 28, one of each of the ribs being on each side of the openings 30. A seen in FIGS. 9–12, the ribs 36, 38 have inwardly disposed detent beads 42 and 44 respectively which extend the length of the rib and impinge into the area over the openings 30.

The backside of the flat section includes a plurality of individual detect tabs 50. Detent tabs 50 are arranged in discrete pairs, with one each of the detent tabs positioned on each side a bore 30. The tabs 50 extend outwardly from the back of section 28, but not as far as the ends of walls 32A, 34A so that the tabs 50 are recessed relative to the walls.

Figure 3:
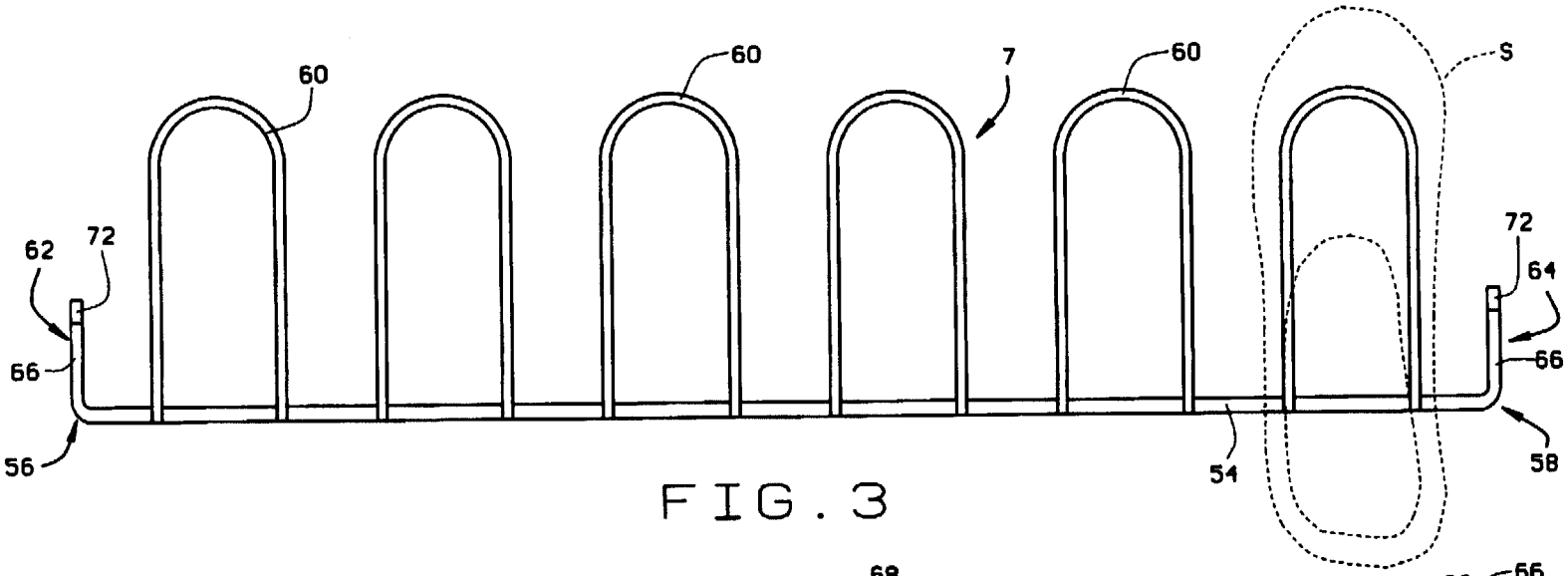
FIG. 3 is a front plant of a wire rack of the adjustable wire rack system of the present invention.
Figure 12:
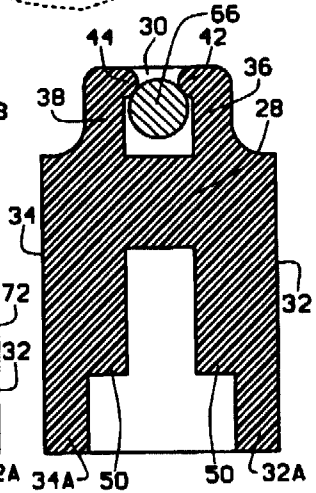
FIG. 12 is a cross sectional view of the section of runner taken along line 12—12 of FIG. 8.
Figure 11:
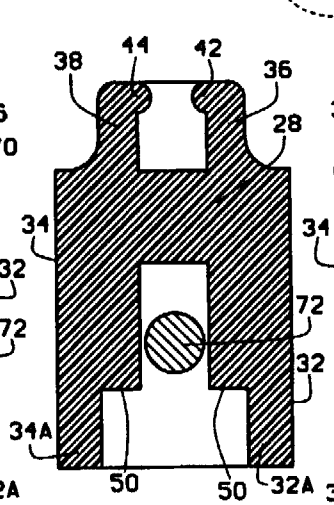
FIG. 11 is a cross sectional view of the section of runner taken along line 11—11 of FIG. 8.
Figure 10:
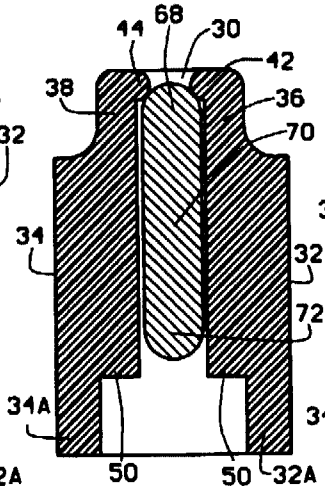
FIG. 10 is a cross sectional view taken of the section or runner along line 10—10 of FIG. 8.
Figure 9:
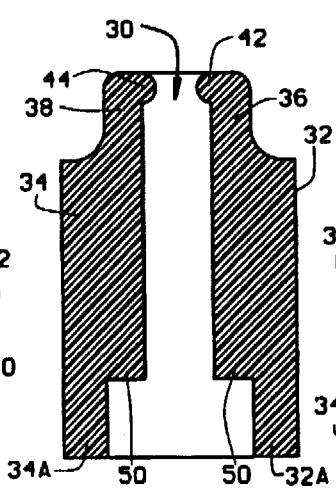
FIG. 9 is a cross sectional view of a section of runner taken along line 9—9 of FIG. 5.
Figure 4:
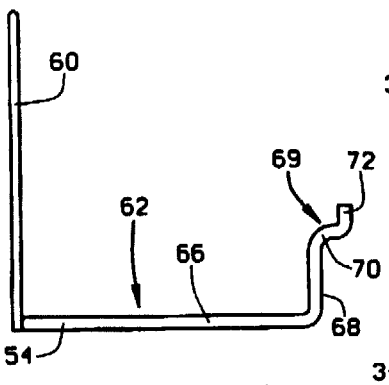
FIG. 4 is an end plan of a wire rack of the adjustable wire rack system of the present invention.

The storage system includes one or more racks 7, as shown in greater detail in FIGS. 3 and 4. Each rack 7 has a horizontal main support 54 which includes a first end 56 and a second end 58. Further, each rack includes a plurality of individual hoops 60 attached to the main support 54. It will be appreciated that each hoop 60 is dimensioned to accommodate a shoe S. It also will be appreciated that, although the figures show the individual hoops 60 as uniform in size and spacing and extending nearly vertically upward, hoops 60 can be varied in size or shape and rearranged in position along support 54 or angled outward, if so desired, without departing from the scope of the invention.

As best seen in FIG. 3, ends 56 and 58 include mounting extensions 62 and 64. Extension 62 is shown in detail in FIG. 4, with extension 64 being the mirror image of extension 62. Each mounting extension includes a horizontal section 66 which is integral with and at a right angle to support 54 and thus protrudes or extends from the back of the rack. Extension 62 includes and vertical section 68 at the distal end. Vertical section 68 includes a substantially S-shaped terminus 69. Terminus 69 includes a relatively short horizontal section 70 and a relatively short vertical tip 72. It will be appreciated that the mounting extensions 62 and 64 just described are configured to lock into the runners 3, 5 in a novel manner that releasably secures the rack in the runner as will now be described in detail.

As best seen in FIGS. 8–12, the vertical tips 72 of the mounting extension 62 and 64 are inserted into parallel openings 30. The entire rack is pivoted downward. The short horizontal section 70 extends outward from the opening. Vertical section 68 is snapped between the ribs 36, 38 and secured by the beads 42, 44 on the front side of the runner. Also, as seen in the figures, the tip 72 does not strike the mounting surface, e.g door D, since the walls 32A, 34A elevate the body of the runner over the mounting surface, as stated above. The novel combination of rack and runner provides a very stable mounted rack.

It will be appreciated that although the preferred embodiment of the runners 3,5 includes both ribs 36 and 38 and the rear tabs 50, the runners 3,5 can be constructed with only ribs 36, 38 (FIG. 5) or only tabs 50 (FIG. 7). Runners having only ribs or only tabs would secure the racks in place, but would not have a double-snap in securing system, as provided in the preferred embodiment, but still would have advantages over the prior art.

Figure 13:
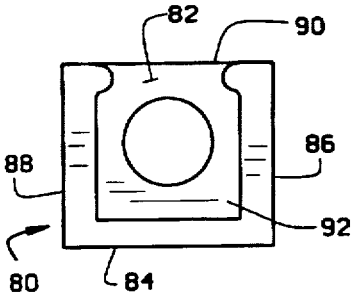
FIG. 13 is a bottom plan of a runner cap.
Figure 13A:
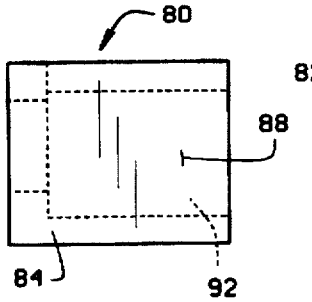
FIG. 13A is a top plan thereof.
Figure 13B:
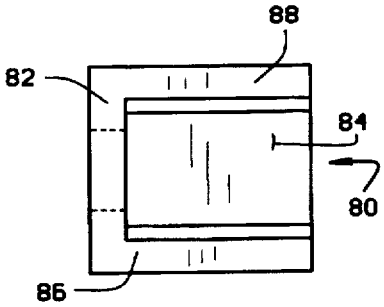
FIG. 13B is a side elevation thereof.

An end cap, shown in greater detail in FIGS. 13–13B, is indicated generally by reference numeral 80. Cap 80 includes a rear wall 82, a bottom wall 84, a first side wall 86, a second side wall 88 and an open front 90 which define an open-sided chamber 92. Chamber 92 is dimensioned to fit over section 20 from the front.

Figure 14:
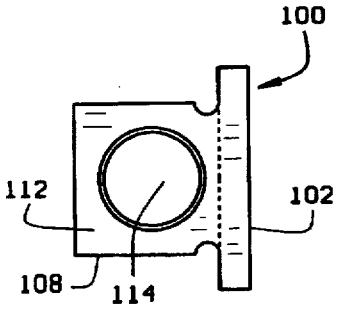
FIG. 14 is an end plan of a runner plug.
Figure 14A:
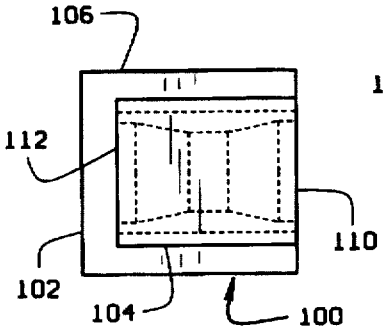
FIG. 14A is a top plan thereof.
Figure 14B:
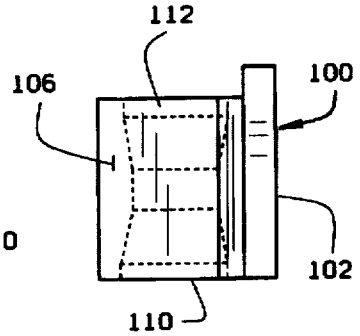
FIG. 14B is a side elevation thereof.

The upper end 15 is finished with an end plug, indicated generally by reference numeral 100 in FIGS. 14–14B. Plug 100 has a flat bottom wall 102. A plug segment 104 is integrally attached to wall 102. Plug segment 104 has a substantially cube configuration formed by bottom wall 102, side wall 106 and 108 and end walls 110 and 112.

Figure 15A:
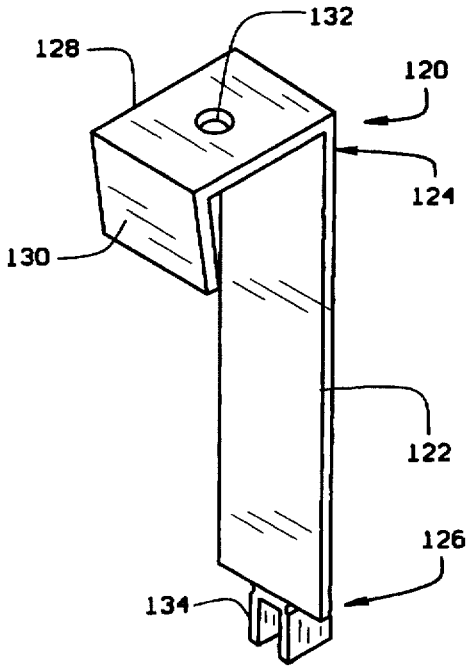
FIG. 15A is an isometric view of a suspension hook.
Figure 15B:
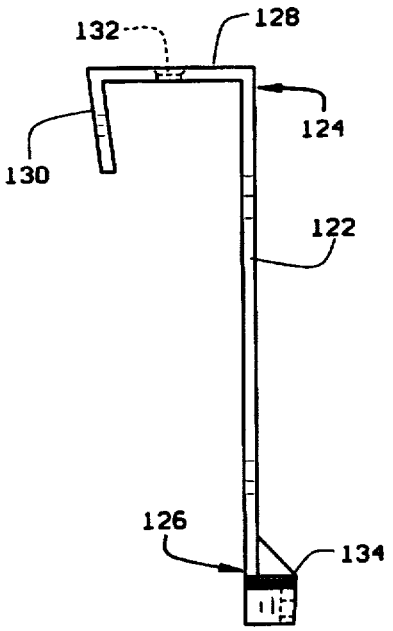
FIG. 15B is a side elevational view thereof.

The rack system of the present invention can be suspended, for a door for example, as shown in FIG. 2, by the use of a pair of suspension hooks 120. Hook 120 is shown in greater detail in FIG. 15. Hook 120 includes an vertical flat body section 122 having a first or top end 124 and a second or bottom end 126. Top end 124 includes a flat horizontal section 128 and a short flat, depending section 130. As will be appreciated, section 128 is just long enough to fit over a door or the like. Depending section 130 can secure the hook on the door edge. An opening 132 is formed in section 128 so that a screw or nail or other fastener device can be introduced to further secure the hook on the door edge. However, the hook will would acceptably well without such securing. Bottom end 126 includes an attachment section 134. Section 134 is constructed in accordance with the principles of plug 100 so that end 22 of the runner can snap over section 134 and be held in place.

It will be appreciated by those skilled in the art that various changes and modifications can be made in the shelving system of the present invention without departing from the scope of the appended claims. For example, various other configurations of the shelves and racks may be employed. Therefore, the description and accompanying drawings should be viewed as illustrative only and should not be construed in a limiting sense.

We claim:

1. An adjustable storage system comprising:

a first side runner element for mounting on a mounting surface;

a second side runner element for mounting on a mounting surface parallel to said first side runner element, each said side runner element having a pair of opposed side walls and a center section between the opposed side walls, said center section including a front side and a back side and a plurality of spaced openings formed through both said sides;

each said side runner having a pair of raised elongated beads on said front side of said center section and running the length of the center section, one of each said beads being positioned on each side of said spaced openings to engage and releasably secure a section of a wire rack attached to said runners;

a plurality of locking tabs on said back side of said center section, one each of said locking tabs being position on each side of said openings and disposed to releasably secure a section of said wire rack; and at least one rack positioned between said side runners, said racks having mounting means on ends thereof for engaging said openings, said beads and said locking tabs.

2. The storage system of claim 1 wherein said openings are evenly spaced.

3. The storage system of claim 1 further comprising a plurality of racks position between said side braces.

4. The storage system of claim 1 wherein each said wire frames includes an upwardly angled hoop, each said hoop disposed to seat a shoe.

5. The storage system of claim 1 wherein each said side brace is comprise of one or more side brace sections, each said section disposed to engage another said section in an interlocking arrangement.

6. The storage system of claim 1 wherein said side walls extend outwardly on the back of said center section beyond said tabs whereby wire rack mounting extensions secured between said tabs do not contact the mounting surface.

7. The storage system of claim 1 further comprising at least on suspension hook for the removable attachment and suspension of a runner.

8. An adjustable storage system for the convenient storage of one or more shoes, comprising:

a first runner for attachment to a mounting surface, said first runner comprised of a plurality of interlocking runner sections, each said section having a plurality of evenly space openings formed in a center section;

a second runner for attachment to a mounting surface parallel to and space apart from said first runner, said second runner comprised of a plurality of interlocking runner sections, each said section having a plurality of evenly spaced openings formed in a center section;

a pair or ribs formed on a front surface of and extending the length of said center section, one each of said pair of ribs being on each side of said plurality of openings, each said rib having a retention bead formed along the edge thereof and position to impinge upon said openings;

a plurality of locking tabs on a back surface of said center section, one each of said tabs being position on each side of one each of said plurality of openings to impinge upon the openings;

at least one rack positioned between said first and second runner, said rack having lateral mounting extensions, said extensions terminating in a retention tip disposed to engage and be secured in said openings, said retention tip releasably engaging between said tabs on the backside of said runner and a segment of said mounting extension releasably engaging between said retention ribs.

9. The storage system of claim 8 wherein said rack is comprised of a horizontally extending wire bar having a first end and a second end, said lateral extension positioned said first end and said second end; said rack including a plurality of upwardly angled wire loops disposed to seat a shoe.

10. The storage system of claim 8 wherein said rack is formed from wire that is subsequently vinyl coated.

11. The storage system of claim 8 wherein said rack is formed of fabricated or formed wire subsequently coated with a vinyl.

12. An adjustable storage system for the convenient storage of one or more shoes, comprising:

a first runner for attachment to a mounting surface, said first runner comprised of a plurality of interlocking runner sections, each said section having a plurality of evenly space openings formed in a center section;

a second runner for attachment to a mounting surface parallel to and space apart from said first runner, said second runner comprised of a plurality of interlocking runner sections, each said section having a plurality of evenly spaced openings formed in a center section;

a pair of ribs formed on a front surface of and extending the length of said center section, one each of said pair of ribs being on each side of said plurality of openings, each said rib having a retention bead formed along the edge thereof and position to impinge upon said openings; and at least one rack positioned between said first and second runner, said rack having lateral mounting extensions, said extensions terminating in a retention tip disposed to engage and be secured in said openings, a segment of said mounting extension releasably engaging between said retention ribs.

13. An adjustable storage system for the convenient storage of one or more shoes, comprising:

a first runner for attachment to a mounting surface, said first runner comprised of a plurality of interlocking runner sections, each said section having a plurality of evenly space openings formed in a center section;

a second runner for attachment to a mounting surface parallel to and space apart from said first runner, said second runner comprised of a plurality of interlocking runner sections, each said section having a plurality of evenly spaced openings formed in a center section;

a plurality of locking tabs on a back surface of said center section, one each of said tabs being position on each side of one each of said plurality of opening to impinge upon the opening;

at least one rack positioned between said first and second runner, said rack having lateral mounting extensions, said extensions terminating in a retention tip disposed to engage and be secured in said openings, said retention tip releasably engaging between said tabs on the backside of said runner.

14. The storage system of claim 13 further comprising a first suspension hook removable attached to said first runner and a second suspension hook removable attached to said second runner.

* * * * *